US007686575B2

(12) United States Patent
Chehab et al.

(10) Patent No.: US 7,686,575 B2
(45) Date of Patent: Mar. 30, 2010

(54) INNER RING WITH INDEPENDENT THERMAL EXPANSION FOR MOUNTING GAS TURBINE FLOW PATH COMPONENTS

(75) Inventors: Abdullatif M. Chehab, Oviedo, FL (US); Scott T. Waechter, Orlando, FL (US); Kevin M. Light, Maitland, FL (US); Brian H. Terpos, Oviedo, FL (US); Zhengxiang Pu, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 772 days.

(21) Appl. No.: 11/506,096

(22) Filed: Aug. 17, 2006

(65) Prior Publication Data

US 2010/0031671 A1 Feb. 11, 2010

(51) Int. Cl.
*F01D 25/26* (2006.01)

(52) U.S. Cl. ..... 415/136; 29/889.22

(58) Field of Classification Search ..... 415/127, 415/136, 138, 173.1, 213.1, 214.1; 29/889.21, 29/889.22

See application file for complete search history.

(56) References Cited

U.S. PATENT DOCUMENTS 3,141,651 A * 7/1964 Moyer ..... 415/136
3,746,463 A * 7/1973 Stock et al. ..... 415/136
4,343,592 A * 8/1982 May ..... 415/173.2
5,018,942 A 5/1991 Ciokajlo et al.
5,035,573 A 7/1991 Tseng et al.
5,049,033 A 9/1991 Corsmeier et al.
5,054,997 A 10/1991 Corsmeier et al.
5,056,988 A 10/1991 Corsmeier et al.
5,096,375 A 3/1992 Ciokajlo
5,104,287 A 4/1992 Ciokajlo
6,126,390 A 10/2000 Bock
6,142,731 A * 11/2000 Dewis et al. ..... 415/136
6,401,460 B1 6/2002 Xia
6,406,256 B1 6/2002 Marx
6,463,729 B2 10/2002 Magoshi et al.
6,733,235 B2 5/2004 Alford et al.
6,877,952 B2 4/2005 Wilson
6,896,484 B2 5/2005 Diakunchak
2005/0265827 A1 12/2005 Wilson, Jr.

* cited by examiner

*Primary Examiner*—Edward Look
*Assistant Examiner*—Nathaniel Wiehe

(57) ABSTRACT

An inner mounting ring (20) for gas turbine flow path components such as shroud ring segments (24). The inner ring (20) may be mounted to an outer ring (22) on radially slidable mounts (26, 28) that maintain the two rings (20, 22) in coaxial relationship, but allows them to thermally expand at different rates. This allows matching of the radial expansion rate of the inner ring (20) to that of the turbine blade tips (32), thus providing reduced clearance (33) between the turbine blade tips (32) and the inner surface of the shroud ring segments (24) under all engine operating conditions. The inner ring (20) may be made of a material with a lower coefficient of thermal expansion than that of the outer ring (22).

7 Claims, 5 Drawing Sheets

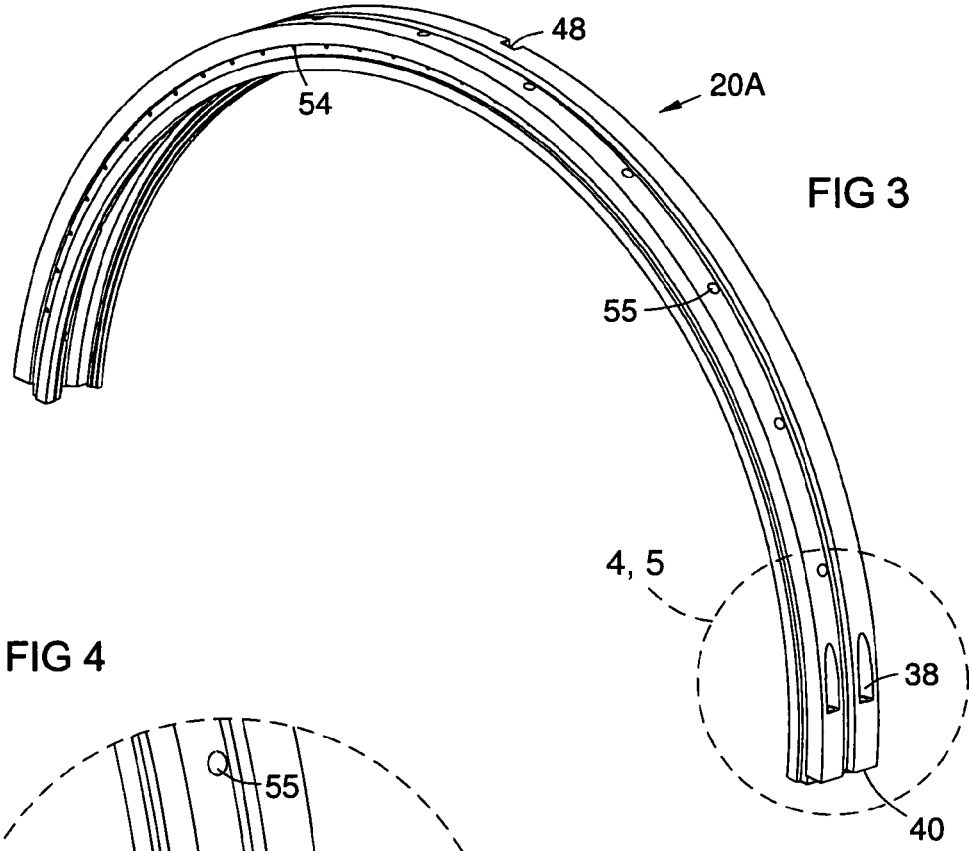
FIG 3
FIG 4
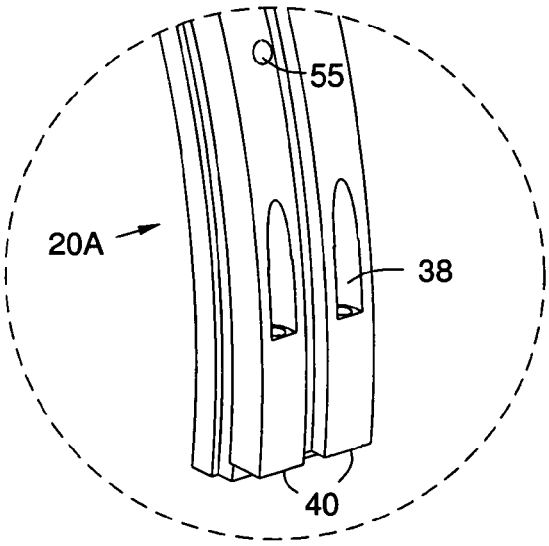
FIG 5
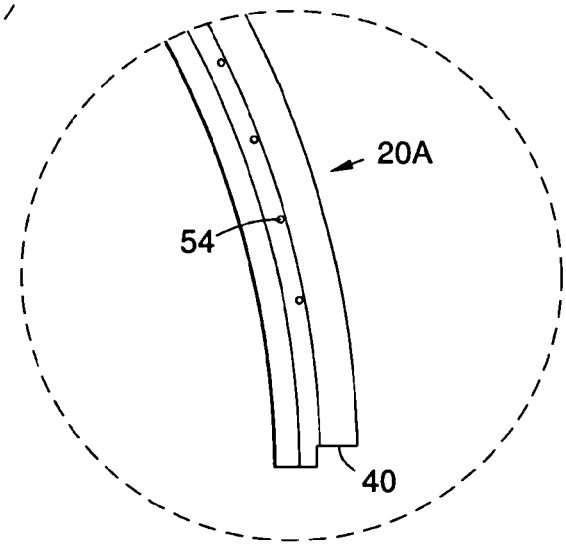

INNER RING WITH INDEPENDENT THERMAL EXPANSION FOR MOUNTING GAS TURBINE FLOW PATH COMPONENTS

FIELD OF THE INVENTION

The invention relates to mounting devices for gas turbine flow path components, and particularly those for mounting shroud ring segments to minimize clearance between the turbine blade tips and the inner surface of the shroud ring segments under steady-state operating conditions.

BACKGROUND OF THE INVENTION

A gas turbine shaft supports a series of disks. Each disk circumference supports a circular array of radially oriented aerodynamic blades. Closely surrounding these blades is a refractory shroud that encloses the flow of hot combustion gasses passing through the engine at temperatures of over 1400° C. The shroud is assembled from a series of adjacent rings supporting flow path components that are typically made of one or more refractory materials such as ceramics. Shroud rings that surround turbine blades are normally formed of a series of arcuate segments. Each segment is attached to a surrounding framework such as a metal ring called a blade ring that is, in turn, attached to the engine case. Close tolerances must be maintained in the gap between the turbine blade tips and the inner surfaces of the shroud ring segments to ensure engine efficiency. However, the shroud ring segments, blade ring, blades, disks, and their mountings are subject to differential thermal expansion during variations in engine operation, including engine restarts. This requires a larger gap and a corresponding efficiency reduction during some stages of engine operation.

Differences among coefficients of linear thermal expansion in flow path components and their support structures dictate the magnitude and variability of blade tip clearances. In prior designs, flow path components such as shroud ring segments are attached directly to support structures such as blade rings. Thus, when the support structures expand, the flow path components are pulled with them. This creates a large blade clearance requirement, partly because of the time delay between heating of flow path components and their more-insulated support structures.

BRIEF DESCRIPTION OF THE DRAWINGS

The invention is explained in the following description in view of the drawings listed below. Herein "axial" means oriented with respect to the axis 16 of the engine turbine shaft 15. An "axial plane" is a plane that includes the axis 16.

FIG. 3 is a perspective view of an upper section of an inner ring 20A.

FIG. 4 is an enlargement of an end of the inner ring of FIG. 3.

FIG. 5 is an enlargement as in FIG. 4 from a viewpoint parallel to the axis.

DETAILED DESCRIPTION OF THE INVENTION

The present inventors have recognized that isolating the thermal expansion of a shroud ring from that of its support structure could minimize differential radial expansion rates between the shroud ring and turbine blades during engine operational transients. This would allow minimizing the radial expansion rate of the shroud ring, thus allowing less clearance between the blades and the shroud ring, increasing power output and efficiency.

Figure 1:
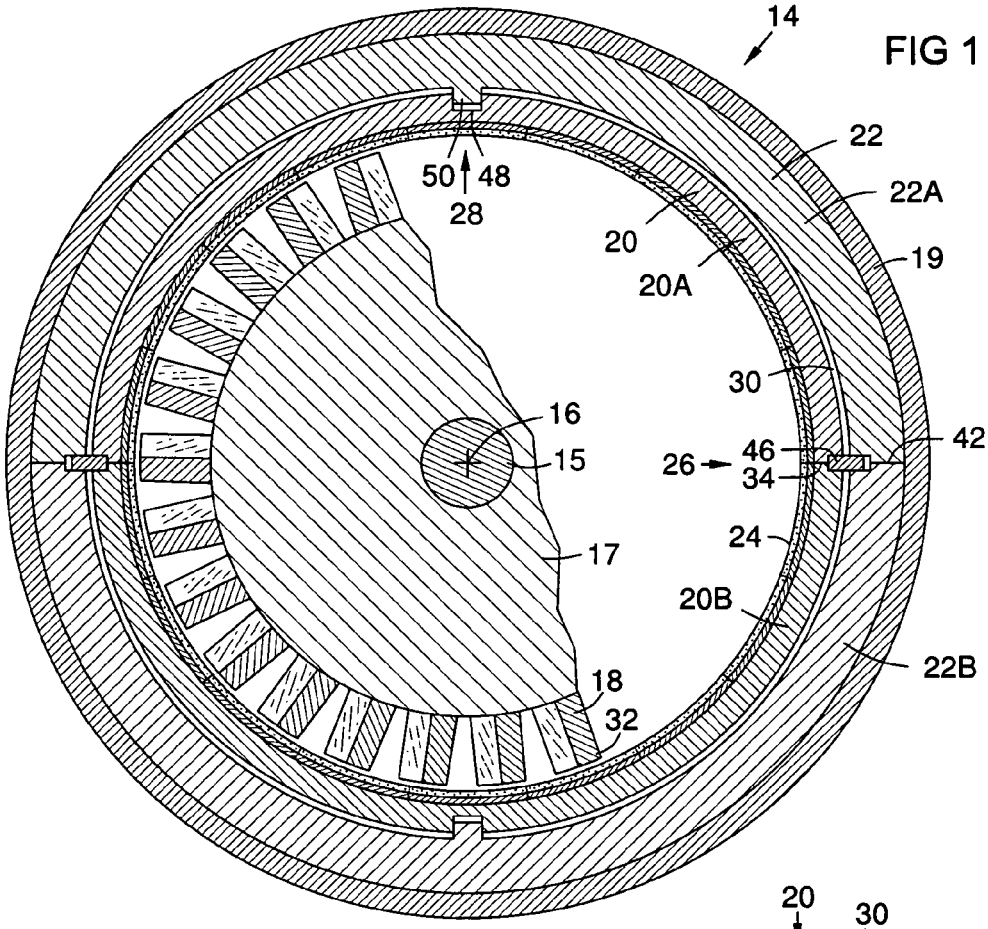
FIG. 1 is a conceptual sectional view taken on a plane normal to the turbine axis showing an inner ring 20 according to the invention mounted within an outer ring 22.

FIG. 1 is a conceptual view of a cross section of a gas turbine 14 with a turbine shaft 15, a shaft axis 16, a disk 17, and blades 18 in a case 19. An inner ring 20 according to the invention is mounted within an outer ring 22. Shroud ring segments 24 are mounted on the inner ring 20. The outer ring 22 may be made of a first material with a first coefficient of linear thermal expansion, and the inner ring 20 may be made of a second material with a lower coefficient of thermal expansion than that of the first material. The inner ring 20 is attached to the outer ring 22 by a plurality of radially slidable mounts 26, 28 that allow radial sliding movement between the inner and outer rings 20, 22. A clearance 30 between the rings 20, 22 provides radial clearance for differential expansion of the rings. The mounts 26, 28 allow the inner ring 20 to expand independently of the outer ring 22 in order to match the radial expansion characteristics of the turbine blade tips 32. A material with a relatively low coefficient of thermal expansion is suggested for the inner ring 20. In one embodiment, a nickel-iron-cobalt alloy sold under the trade name designation INCOLOY® alloy 909 (UNS NI9909) may be used. INCOLOY alloy 909 is known to have the following chemical composition: nickel 35.0-40.0%; cobalt 12.0-16.0%; niobium 4.3-5.2%; titanium 1.3-1.8%; silicon 0.25-0.50%; aluminum 0.15 maximum; carbon 0.06 maximum; iron balance. A material for the inner ring may be further selected for improved wear and oxidation resistance at elevated temperatures.

Figure 2:
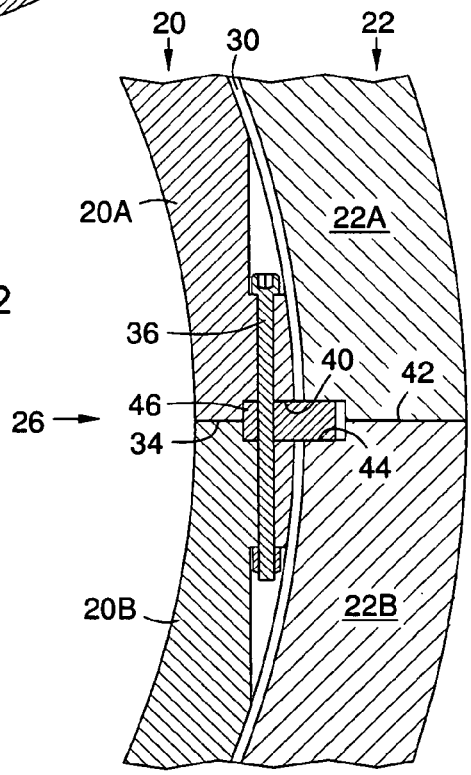
FIG. 2 is a more detailed sectional view of a joint between upper and lower halves of the inner and outer rings of FIG. 1.
Figure 8:
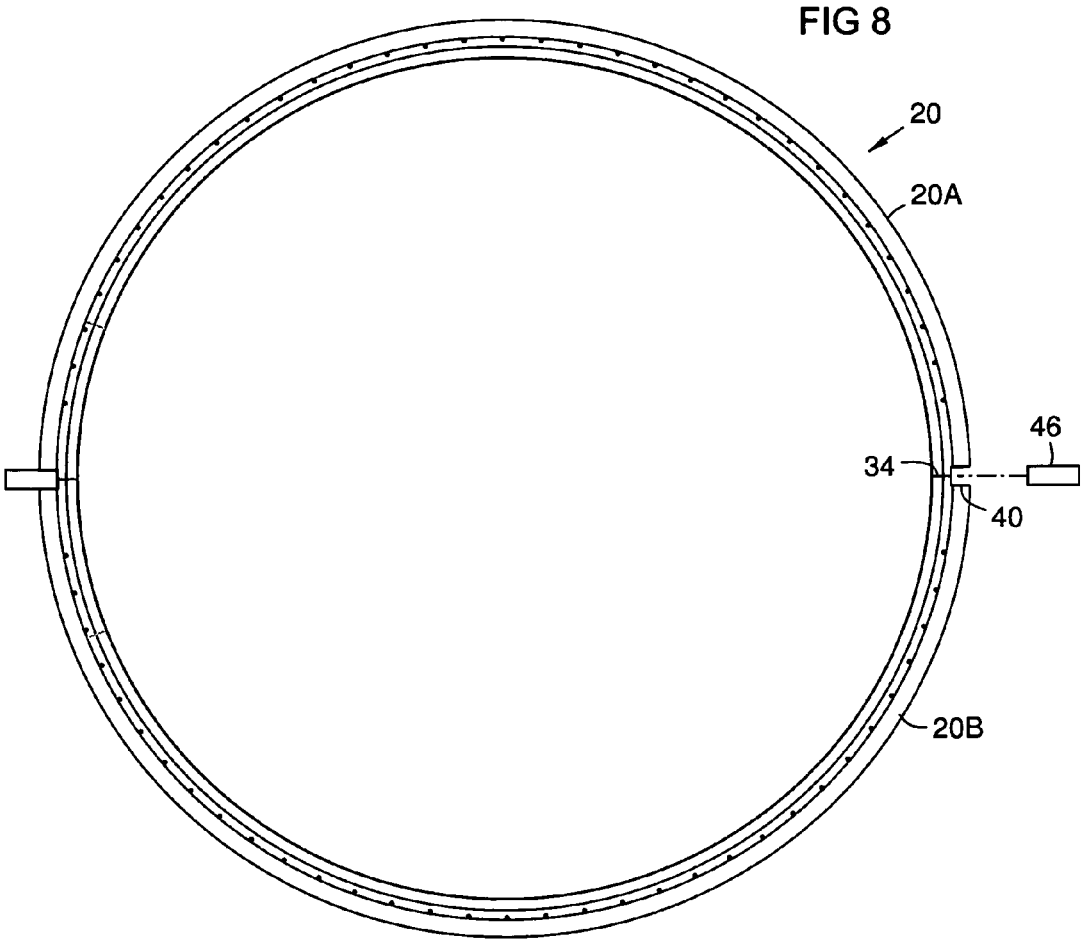
FIG. 8 is a view of the inner ring formed from first and second halves.

As shown in FIG. 2 the inner ring 20 may have first and second halves or sections 20A, 20B that are bolted together at a joint 34. A pair of bolts 36 may pass through the abutting ends of the sections 20A, 20B to connect them. Recessed holes 38 for such bolts 36 are shown in FIGS. 3 and 4, which also show segment locking holes 55. As shown in FIGS. 4, 5 and 8 a key clamp 40 is defined in each joint 34 between the upper and lower sections 20A, 20B of the inner ring 20.

The outer ring 22 may also have first and second halves or sections 22A, 22B that are similarly joined at abutting ends. The resulting joint 42 forms a key slot 44 in the outer ring 22 opposite the key clamp 40 in the inner ring 20. A key 46 may be clamped in the key clamp 40 as shown in FIG. 2, and the bolts 36 may pass through it. The key 46 is radially slidable in the key slot 44. This mounting mechanism fixes the rotational position of the inner ring 20, but allows relative radial movement between the inner ring 20 and the outer ring 22. Alternately (not shown) the key 46 may be fixed in the outer ring 22 and slidable in the inner ring 20, or slidable in both rings.

Figure 9:
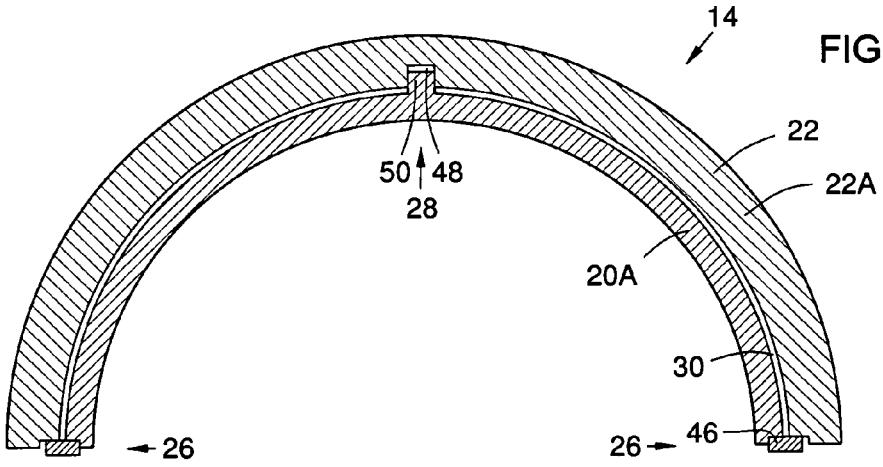
FIG. 9 is a view of an alternate embodiment of the alignment tabs 46 and 50 and tab slots 48.

Upper and lower tabs slots 48 and tabs 50 may be provided on the outer and inner rings 20, 22 as illustrated in FIG. 1. The tabs 50 slide radially in the tab slots 48. The interfacing of these tab slots 48 and tabs 50 keeps the inner ring 20 centered laterally within the outer ring 22. Alternately as in FIG. 9 the tabs 50 may be disposed on the inner ring 20, and the tab slots 48 may be on the outer ring. Alternately (not shown) the inner ring 20 may be made in four sections, and the tabs 50 may be formed using keys 46 at the resulting upper and lower joints 28 similarly to the other two joints 26 shown.

The key slots 44 and/or the tab slots 48 may be formed as enclosed chambers except for an open radially inner end that receives the key 46 or tab 50. Such a chamber fixes the inner ring 20 in the outer ring 22 against movement parallel to the turbine axis 16. Thus, the only freedom of movement between the inner and outer rings is a centered radial expansion. However, not all of the key slots 44 and tab slots 48 need be axially restrictive. A combination of four radially slidable mounts 26, 28 at four cardinal points as shown is ideal because it maintains a coaxial relationship of the rings 20, 22, while allowing differential radial expansion of them, and allowing assembly of them.

Figure 10:
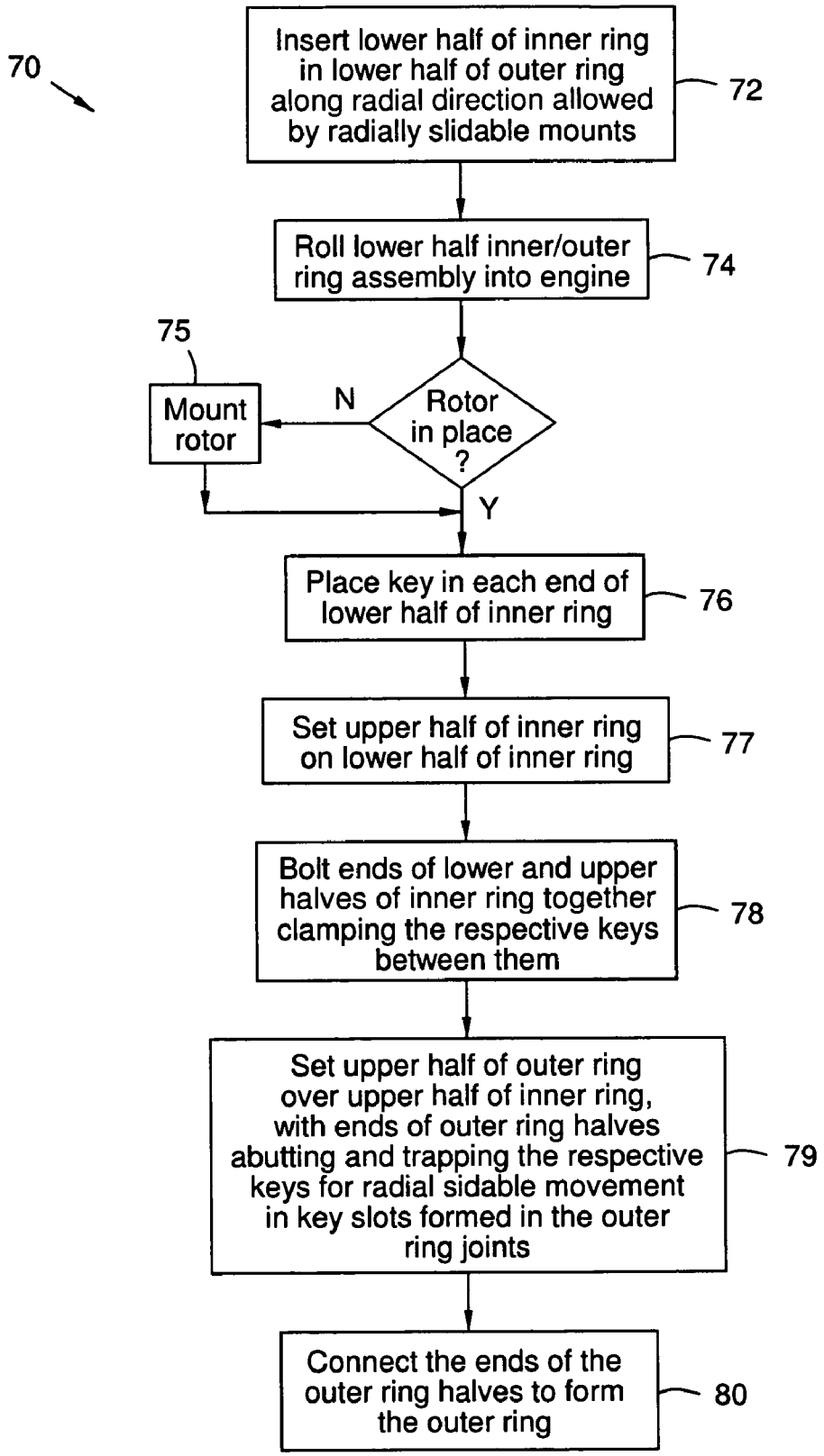
FIG. 10 illustrates an assembly method for the inner and outer rings and mounts.

For assembly 70 as illustrated in FIG. 10, the lower half of the inner ring 20B may be inserted 72 into the lower half of the outer ring 22B along the radial direction allowed by the tab slots 48 and tabs 50. This forms a lower half inner/outer ring assembly, which is then rolled 74 into the engine, with or without the rotor in place. Before the upper half of the ring assembly is made, the rotor must be in place 75. A respective key 46 is then placed 76 in each end of the lower half of the inner ring 20B. The upper and lower sections 20A, 20B of the inner ring are then bolted together 77, 78, clamping the respective keys 46 between them. Finally, the upper outer ring section 22A is lowered 79 over the upper inner ring section 20A along the radial direction allowed by the tab slots 48 and tabs 50. The upper and lower outer ring sections 22A, 22B are then connected together 80, trapping the keys 46. This retains the keys 46 radially slidably within the key slots 44 in the abutting ends of the outer ring sections 22A, 22B.

Figure 6:
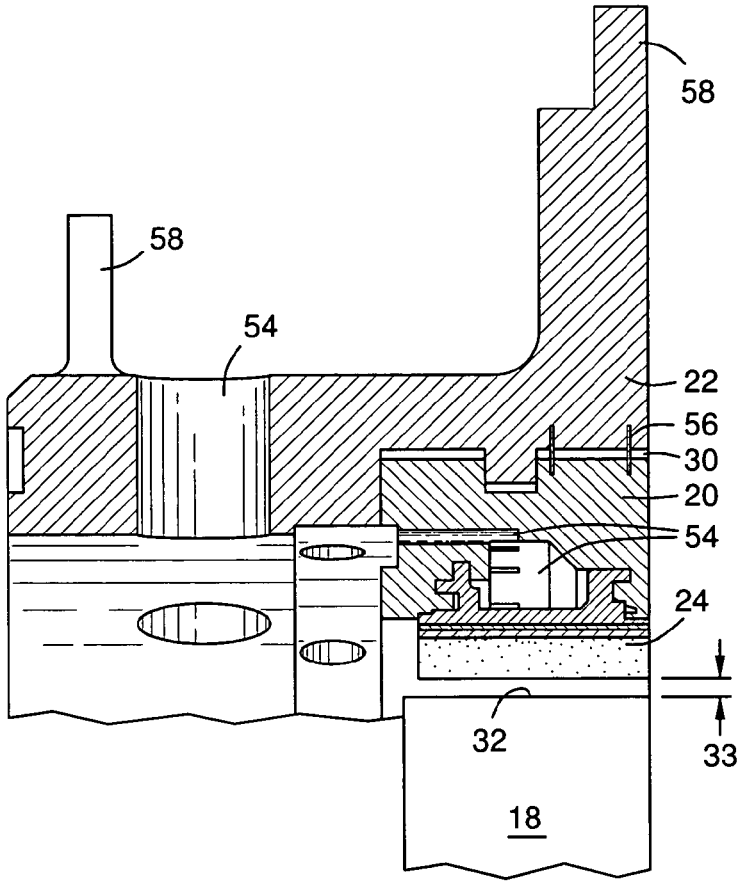
FIG. 6 is a sectional view, taken on an axial plane, of a shroud ring segment 24 mounted in an inner ring 20 which is in turn mounted in an outer blade ring 22.
Figure 7:
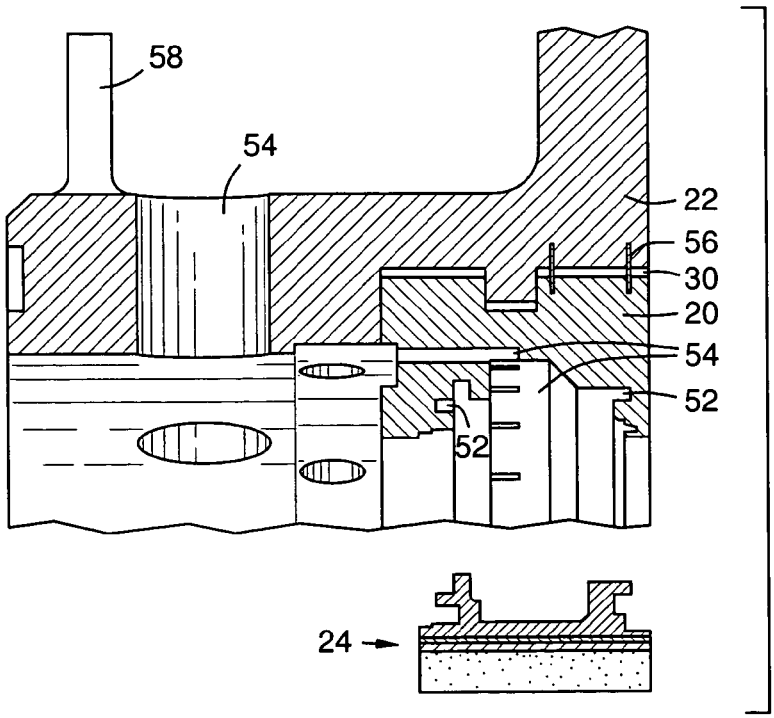
FIG. 7 is a view as in FIG. 6 with the shroud ring segment 24 exploded for clarity.

As shown in FIGS. 6-7 shroud ring segments 24 may be assembled onto the inner ring halves 20A, 20B by sliding the shroud ring segments 24 into tracks 52 in each inner ring half 20A, 20B before the other assembly steps above. Alternately the shroud ring segments 24 may be assembled onto the inner ring 20 by other means known in the art. A track-and-slide assembly geometry is illustrated in FIGS. 6-7, which also show air cooling channels 54 and gas seals 56. Bosses 58 are provided for mounting the outer ring 22 to the engine case 19.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine flow path component mounting apparatus comprising:

an outer in a casing of the gas turbine; and an inner ring for mounting gas turbine flow path components, the inner ring being mounted within the outer ring on four radially slidable mounts between the two rings that maintain the inner and outer rings in coaxial relationship, but allows them to thermally expand at different rates;

wherein the inner ring comprises first and second halves, the outer ring comprises first and second halves, and the radially slidable mounts are positioned 90 degrees apart on the inner and outer rings, a first and second of the of the radially slidable mounts comprising respective first and second keys that are bolted into respective first and second joints between the first and second halves of the inner ring, the first and second keys received in respective first and second slots in respective first and second joints between the first and second halves of the outer ring, each slot being formed as an enclosed chamber except for an open radially inner end thereof that receives the respective key and allows only radial motion of the key.

2. The gas turbine flow path component mounting apparatus of claim 1 wherein the inner ring is made of a material with a lower coefficient of thermal expansion than a coefficient of thermal expansion of the outer ring.

3. A method of assembling the gas turbine flow path component mounting apparatus of claim 1, comprising:

mounting shroud ring segments in tracks in each inner ring half;

inserting the first half of the inner ring into the first half of the outer ring along a radial direction allowed by the radially slidable mounts;

bolting the first and second halves of the inner ring together forming the joints between the first and second halves of the inner ring; and finally bolting the first and second halves of the outer ring together forming the two respective joints between the first and second halves of the outer ring.

4. A gas turbine flow path component mounting apparatus comprising:

an outer ring made of a first material with a first coefficient of thermal expansion;

an inner ring made of a second material with a lower coefficient of thermal expansion than that of the first material, wherein the inner ring is attached to the outer ring by four radially slidable mounts spaced 90 degrees apart around the two rings, the four radially slidable mounts spanning a clearance gap between the two rings, and wherein each of at least two diametrically opposed ones of the radially slidable mounts comprises a radially oriented key clamped in a joint between sections of one of the rings and slidably received in a key slot in a respective joint between sections of the other of the rings;

wherein each key slot only allows radial motion of each key therein relative to the respective joint.

5. A gas turbine flow path component mounting apparatus comprising:

an outer ring made of a first material with a first coefficient of thermal expansion;

an inner ring made of a second material with a lower coefficient of thermal expansion than that of the first material, wherein the inner ring is attached to the outer ring by a plurality of mounts that allow relative radial sliding movement between the inner and outer rings during differential thermal expansion of the inner and outer rings, while retaining the inner ring centered within the outer ring;

wherein a first and a second of the mounts are diametrically opposed, each of the first and second mounts comprising a key clamped between first and second halves of the inner ring and retained slidably in a key slot formed between first and second halves of the outer ring, each key slot formed as a chamber that is open only at a radially inner end that only allows radial movement of the key therein; and a third and a fourth of the mounts are diametrically opposed and 90 degrees offset from the first and second mounts, and each of the third and fourth mounts comprises a tab on the inner ring or the outer ring and a respective tab slot in the other of the two rings, each tab being radially slidable in the respective tab slot.

6. The gas turbine flow path component mounting apparatus of claim 5, wherein each inner ring half comprises first and second ends, the respective ends of the two inner ring halves abutting and connected by at least one bolt to form the inner ring with respective first and second inner ring joints, each inner ring joint clamping a respective key that extends radially from each inner ring joint, said at least one bolt passing through the respective key.

7. A method for assembling the gas turbine flow path component mounting apparatus of claim 6 comprising:

inserting the first half of the inner ring in the first half of the outer ring;

placing a respective key in each end of the first half of the inner ring;

setting the second half of the inner ring on the first half of the inner ring;

bolting the ends of the first and second halves of the inner ring together, clamping the respective keys between them;

setting the second half of the outer ring over the second half of the inner ring with the ends of the outer ring halves abutting and trapping the respective keys for radial slidable movement in the key slots formed in the outer ring joints; and connecting the ends of the outer ring halves to form the outer ring.

* * * * *